US006040780A

United States Patent [19]

Lucas

[11] Patent Number: 6,040,780

[45] Date of Patent: Mar. 21, 2000

[54] CHILD'S PERSONAL SECURITY ASSISTANT

[76] Inventor: Michael Lucas, 146 Quassaic Ave., New Windsor, Mass. 12553

[21] Appl. No.: 09/208,513

[22] Filed: Dec. 9, 1998

[51] Int. Cl.[7] ..... G08B 3/00

[52] U.S. Cl. ..... 340/691.1; 340/321; 340/573.1; 340/693.8

[58] Field of Search ..... 340/691.1, 691.4, 340/691.5, 686.4, 693.5, 693.8, 326, 331, 332, 321, 573.1, 568.1, 568.8, 571; 362/253, 801, 20

[56] References Cited

U.S. PATENT DOCUMENTS

| | | | |
|---|---|---|---|
| 4,241,870 | 12/1980 | Marcus | 340/825.69 X |
| 4,821,026 | 4/1989 | Newsom | 340/691.5 X |
| 5,573,109 | 11/1996 | Isacson | 362/253 X |
| 5,578,992 | 11/1996 | Harding | 340/691.5 X |
| 5,587,645 | 12/1996 | Sciammarella et al. | 362/253 |
| 5,644,294 | 7/1997 | Ness | 340/691.5 X |

*Primary Examiner*—Thomas Mullen

*Attorney, Agent, or Firm*—Mark P. White

[57] ABSTRACT

A child's personal security assistant is intended for use during house fires, and assists rescuers in finding children trapped or hidden within the house, also providing information about the child to assist in medical treatment after rescue. The device is in the form of a stylized miniature fire hydrant, and has a dual function as a clock, intended to be located on a night stand alongside the child's bed. The device includes a stand powered by house current, and a body mated with the stand, both physically and electrically. A timer is located on the body, with a readout visible from the front. A row of strobe lights are located on the outside top of the body, as is a flashlight. The body also contains a sonic alarm located within. The body is powered by re-chargeable electrical batteries located within the body, which are constantly charged by the house-current when the body is connected to the stand. When the body is removed from the stand the timer is activated, as are the lights and sonic alarm. The device further includes a storage compartment within the body where biographic information of the child who owns the device is kept.

9 Claims, 4 Drawing Sheets

CHILD'S PERSONAL SECURITY ASSISTANT

FIELD OF THE INVENTION

This invention relates to personal security devices, and more specifically to such devices used to assist firemen, rescuers, and emergency medical personnel in finding and assisting young children who have been trapped in house fires.

BACKGROUND OF THE INVENTION

The present invention is intended to assist fire fighting personnel and emergency medical personnel in locating and assisting children in the wake of a house fire. A review of the prior art discloses many personal security devices intended to alert people in the event of a fire. The present invention, however, is used not to alert people to the onset of a fire, but rather to assist others, such as firefighters and EMTs, in coming to the assistance of those children caught in a fire.

Through personal experience of the inventor, who is a firefighter, it has been found that children, especially young children, tend to hide when an emergency occurs. Typically, children will seek the shelter of a closet, not realizing that the closet will ultimately not protect them from a fire. To the contrary, historically, the tendency of children to seen shelter within the house, rather than leaving the house, has prevented firefighters from locating them.

The current invention will assist firefighters in locating children in house fires. The child must first be taught to pick up the device and keep it with him at all times. It contains both audible and visible alarms, which are self-activating when the device is picked up by the child. These alarms help lead rescuers to the child, wherever he might be within the house. Furthermore, the invention includes a timer, which indicates the time elapsed from when the device was picked up. This time approximates time since the fire was first noticed by the child using the invention, and is important after rescue, since it indicates how long the child may have been exposed to smoke, etc.

The device also contains a storage compartment, or container, in which biographic data, and medical history data are stored, for use by both firefighters and by medical personnel after rescue is accomplished. Information, such as the name and age of the child, drugs to which the child is allergic, and the child's pre-existing medical conditions may be essential to appropriate treatment of the child. Under emergency conditions, when the child is injured after rescue, as a result of burns, smoke inhalation, or the like, the availability of such information may save the child's life.

The present invention is a dual-function device. It serves as an attractive clock in the form of an anthropomorphic fire hydrant, which children will find appealing. It sits on its base on a night stand next to the child's bed. When removed from its base, however, the timer is initialized, as are the visible and audible alarms. Radio-frequency (RF) alarms may also be included. The child, who has previously been taught to pick up the device in case of fire, and to keep it with him, thus signals the firefighters as to his whereabouts, even if the child is not visible.

The visible alarms consist of strobe lights, which will enable rescuers to see the device even when the area is filled with thick smoke. The audible alarm, typically beeping at short intervals with a characteristic sound, will likewise direct rescuers to the child in distress, even if the child is out of sight.

The device also contains a flashlight mounted on the top of the hydrant. This enables the child to find his way about the house, in the case where it is dark and he is unable to find a light switch, or in cases where the electrical power to the house is shut down.

It is contemplated that when this invention is widely available, firefighters and other rescue personnel will be informed about the device and its operation, and will be able to quickly recognize the signals the device produces.

SUMMARY OF THE INVENTION

It is a general object of the invention to provide a device to assist rescuers in locating children within a house under emergency circumstances. It is a further object of the invention to provide rescuers with personal, biographic, and medical information regarding the child after rescue, to comfort the child, and to assist in medical treatment.

In accordance with one aspect of the invention, a child's personal security assistant includes a stand and a body removeably mated with the stand, and connected electrically to it. The body include a front, a timer located on the body, with a readout visible from the front, electrical storage means located within the body, and one or more switchable strobe lights located on the outside of the body, and powered by the storage means. The body also contains a switchable sonic alarm located within the body and powered by the storage means as well as means to detect removal of the body from the stand. Finally means are provided to communicate the removal to the timer, strobe lights, and sonic alarm, and switching them on as a result.

According to a second aspect of the invention, the device also includes a switchable flashlight, and means to communicate to the flashlight the removal of the device from its base, switching it on as a result.

According a third aspect of the invention, the base further includes plug means to electrically connect it to normal house current, charging means, and electrically conductive means to allow the charging means to charge the storage means.

According to a fourth aspect of the invention, the timer is an electrical timer, and the readout is an electronic readout.

According to a fifth aspect of the invention, the device further includes storage means within the body where personal information of the child who owns the device may be kept.

According to a sixth aspect of the invention, the device also includes a lighted handle.

According to a seventh aspect of the invention a clock is mounted in the front of the body.

According to a final aspect of the invention, the electrical means to power the clock and lighted handle are from the house current when the body is mated to the base, and from the power source when said body is not mated to the base.

BRIEF DESCRIPTION OF THE DRAWINGS

These, and further features of the invention, may be better understood with reference to the accompanying specification and drawings depicting the preferred embodiment, in which.

DESCRIPTION OF THE PREFERRED EMBODIMENTS

Figure 1:
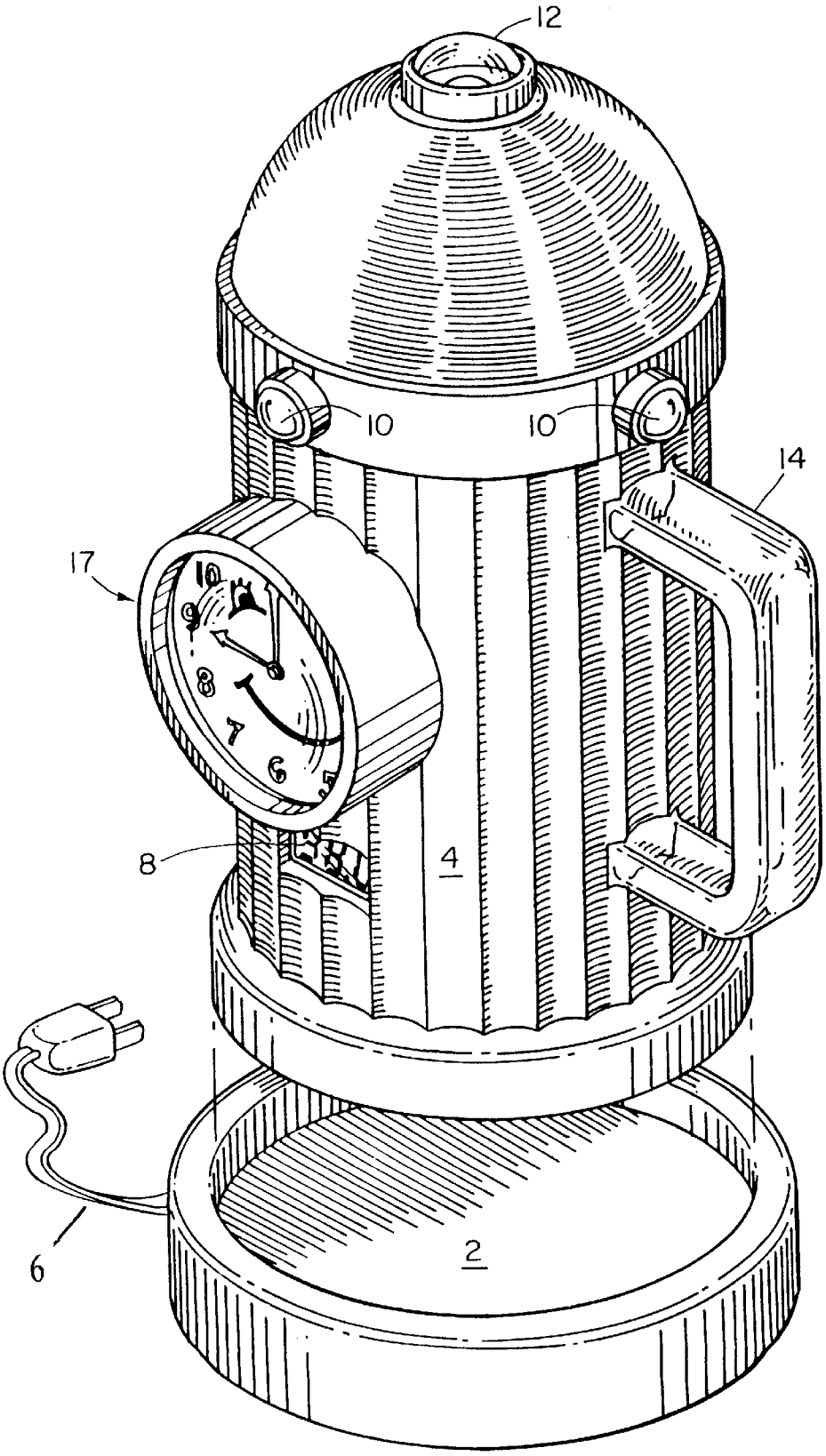
FIG. 1 depicts a perspective view of the device, showing the main body offset from the timer activation base.
Figure 2:
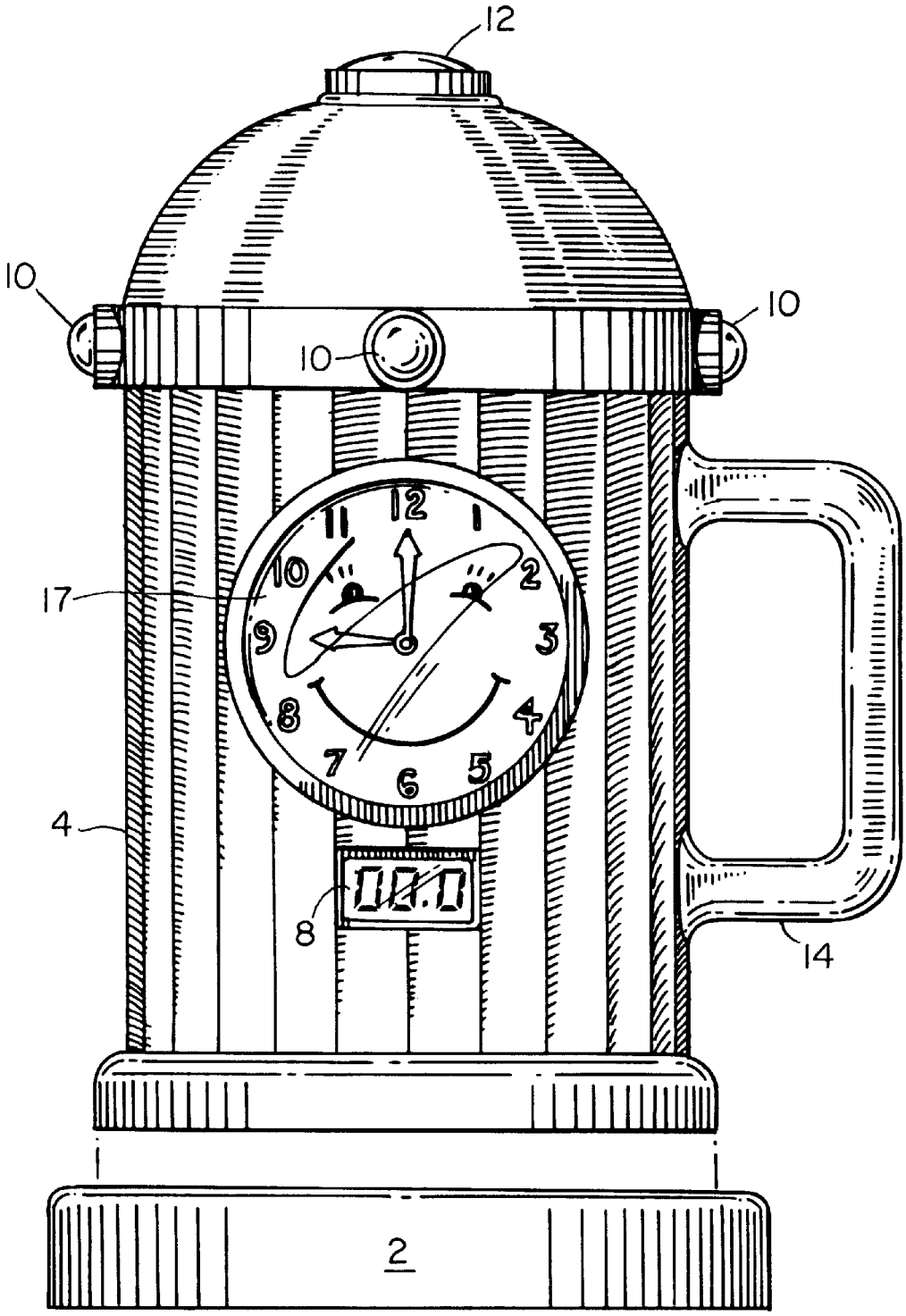
FIG. 2 depicts a front elevation view of the device, showing the main body offset from the timer activation base, and revealing the location of the exposure timer beneath the clock face.
Figure 3:
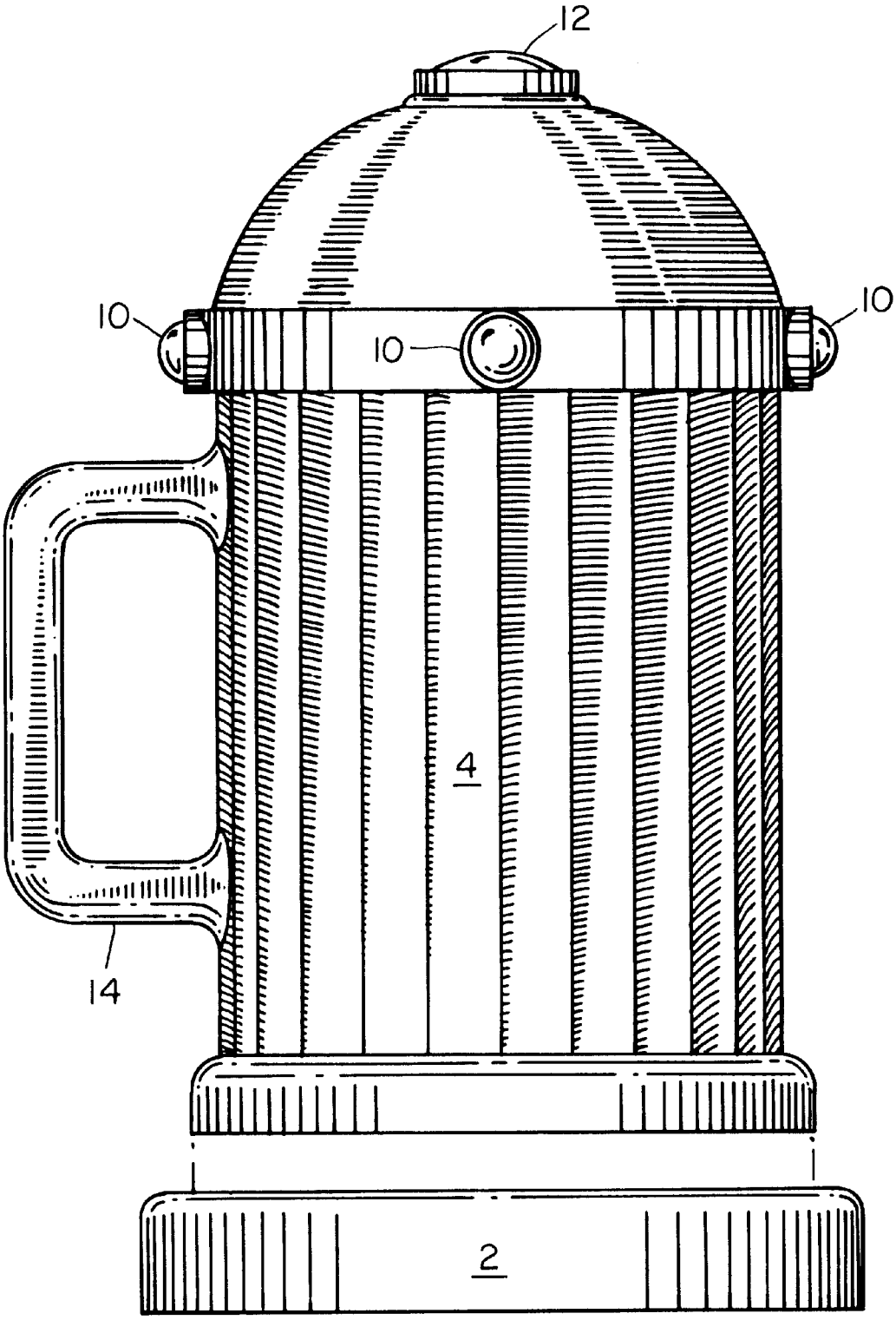
FIG. 3 depicts a side elevation view of the device, showing the lighted handle.

The invention may be understood by first referring to FIG. 1, which depicts the invention in its first preferred embodiment. Referring to FIG. 1, the invention is seen to have the general appearance of a miniature, old-fashioned fire hydrant. Such an appearance helps condition the child to regard fire-fighting equipment as familiar and non-threatening.

The invention includes a base 2, and a body 4, which, under normal circumstances, are mated together, the body resting on the base. The base contains an electrical cord 6, which plugs into a normal home electrical utility outlet. This base contains a battery charger (not shown), and mates with the body through a pair of recessed electrical contacts (also not shown). These contacts are made in such a way as to prevent accidental electrical shocks to the children using the invention, typically by recessing the contacts.

Although the battery charger may be located in the body, it is clearly preferable for the charger to be in the base, both to minimize the weight of the body, which will be carried by the child in case of fire, and to reduce shock hazard. Shock is reduced because, when the charger is in the base, the output transmitted to the body is a low, DC voltage corresponding to that of the battery.

The body contains a number of elements important to the use of the invention. First, there is the timer 8, which is activated when the body is removed from the base, and reset when the body is returned to the base. The timer has an electronic display, typically an illuminated LCD display, which can display up to 999 minutes. A clock 17 is located above the timer.

Next, the body includes a number of strobe lights 10 arranged symmetrically around the exterior of the hydrant. These strobe lights provide a visual aid to help rescuers locate the child holding onto the device. They provide short bursts of high illumination, and will thus be visible even in dense smoke, and despite the bright lights which may accompany rescue operations.

In the center of the top of the hydrant which forms the body there is a flashlight bulb and reflector 12. The flashlight, like the strobe light, will be automatically switched on when the body is removed from the stand. The flash light is used by the child in case the house is dark when the fire begins. Often, electrical power will fail with the onset of a fire, and the house may be in darkness before the flames allow the occupants to see clearly.

Within the body, but not shown in FIG. 1 is an audible alarm. This alarm is important if the child is in an area not within the line of sight of the rescuer. It is a signal to the rescuer that a child is still trapped inside the burning house. This is especially important in the case when the child has sought shelter in a closet, bathroom, or other room other than the bedroom where the child usually sleeps.

The nature of the audible alarm is to produce short, high volume bursts of sound. This not only is distinctive, and therefore, easy to find, but it also prevents excessive drain on the battery. Likewise, strobe lights produce less of a battery drain, with higher illumination, then non-intermittent lights.

Figure 4:
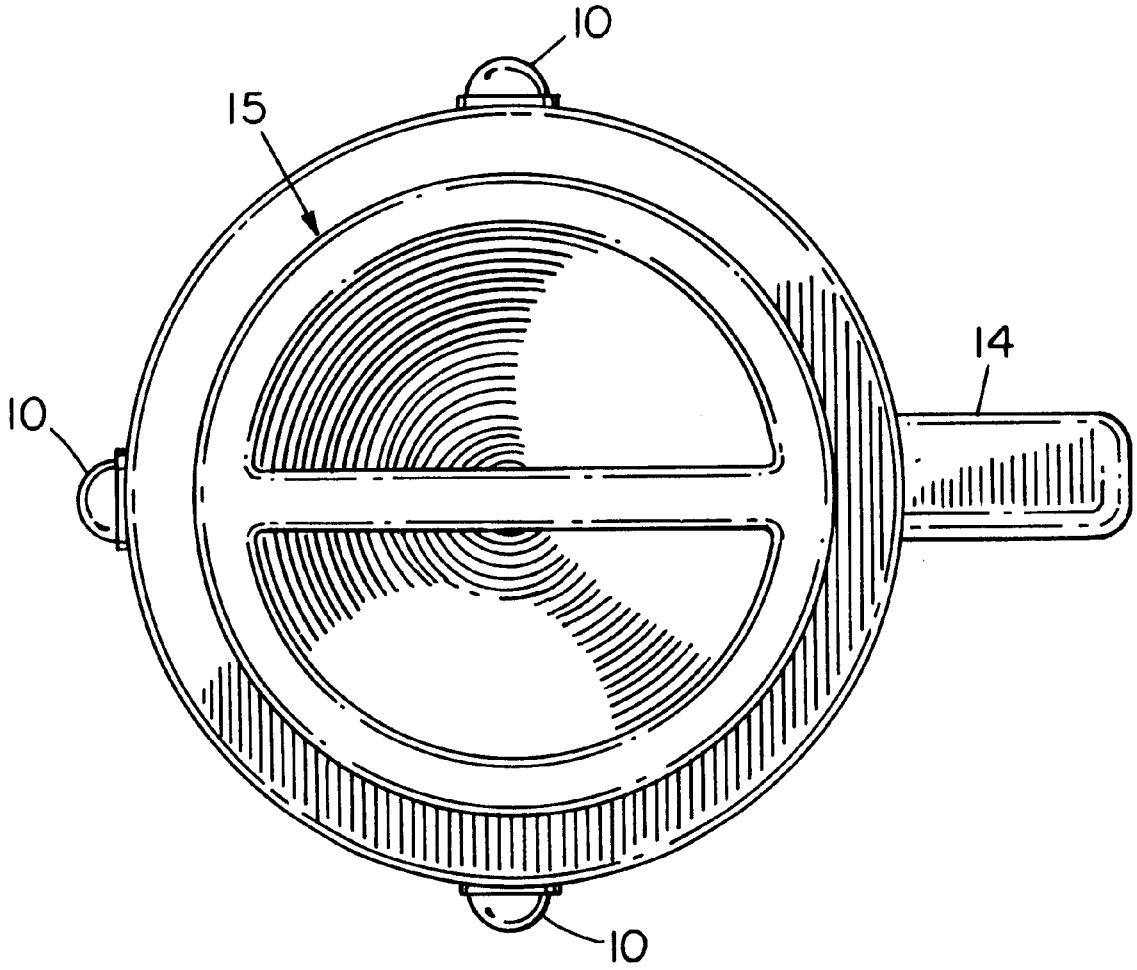
FIG. 4 depicts a bottom plan view of the device, showing the entry to the battery and information container.

Within the bottom area of the body there is a storage compartment, whose cover 15 appears in the bottom plan view depicted in FIG. 4, and in which the child's parents will have place biographical and medical information concerning the child. This information includes, name, age, allergies, medical problems, etc., which information may be critically needed by medical rescuers who need to provide emergency help. The information is even more important if the rescued child is not conscious, or is unable to communicate because of physical or psychological trauma.

In the embodiment shown in FIGS. 1–4, the entrance to the battery storage compartment is accessed by the same cover 15 in which the biographical data is stored.

The body also contains a lighted handle 14, which helps the child locate the device while still on its base, since the strobe lights and flashlight will not be set off until the body is removed. The light in the handle may go off when the body is removed from the base, so as to conserve electricity. In the first preferred embodiment, the handle is powered directly from the house current, but is not connected to the battery within the body.

Non-electrical means may also be used for the handle after the body is removed from the base. These include chemical means, triggered by a physical rupture of a membrane separating two different chemicals, whose combination results in the generation of light, a well known effect.

The battery must be of a high-capacity, rechargeable type, and one which avoids overcharging, since the charger will be constantly activated when the body is mounted on its base. The battery should be able to keep the strobe light, timer, and audible alarm running for several hours without needing to be recharged.

It should be emphasized that other types of alarms may be included in this device, including RF alarms which are activated simultaneously with activation of the other alarms. These are considered to be of secondary importance, however, since they require corresponding receivers on the part of the rescuers, which may not be readily available when needed.

It will be apparent that improvements and modifications may be made within the purview of the invention without departing from the scope of the invention defined in the appended claims.

I claim:

1. A child's personal security assistant, comprising:

an electrically powered stand;

a body removeably mated with said stand, and connected electrically thereto, and further comprising:

a front;

a timer located on the body, with a readout visible from the front;

electrical storage means located within the body;

means for recharging the storage means;

one or more switchable strobe lights located on the outside of the body, and powered by the storage means;

a switchable sonic alarm located within the body and powered by the storage means;

means to detect removal of the body from the stand; and means to communicate said removal to the timer, strobe lights, and sonic alarm, switching them on thereby.

2. The device of claim 1, further comprising a switchable flashlight, located on the body, and further comprising means to communicate said removal to the switchable flashlight, switching it on thereby.

3. The device of claim 2, wherein the recharging means are located within the base.

4. The device of claim 3, wherein the timer is an electrical timer, and the readout is an electronic readout.

5. The device of claim 4, further comprising container means within the body wherein the owner's personal information may be kept.

6. The device of claim 5, further comprising a lighted handle.

7. The device of claim 6, wherein the lighted handle further comprises an electrically lighted handle.

8. The device of claim 7, further comprising a clock mounted in the front of the body.

9. The device of claim 8, wherein the device is used in a house having house current, and further comprising electrical means to power the clock and lighted handle from said house current when the body is mated to and electrically connected with the stand, and from said electrical storage means when said body is not mated to and electrically connected with the stand.

* * * * *